US008425652B2

(12) United States Patent
Alm et al.

(10) Patent No.: US 8,425,652 B2
(45) Date of Patent: Apr. 23, 2013

(54) METHOD OF MAKING A SUBMICRON CEMENTED CARBIDE POWDER MIXTURE WITH LOW COMPACTING PRESSURE AND THE RESULTING POWDER

(75) Inventors: Ove Alm, Hägersten (SE); Alistair Grearson, West Midlands (GB); Susanne Norgren, Huddinge (SE)

(73) Assignee: Sandvik Intellectual Property AB, Sandviken (SE)

( * ) Notice: Subject to any disclaimer, the term of this patent is extended or adjusted under 35 U.S.C. 154(b) by 975 days.

(21) Appl. No.: 11/493,853

(22) Filed: Jul. 27, 2006

(65) Prior Publication Data

US 2007/0025872 A1 Feb. 1, 2007

(30) Foreign Application Priority Data

Jul. 29, 2005 (SE) ..... 0501746

(51) Int. Cl.
*B22F 1/00* (2006.01)
*C22C 29/00* (2006.01)

(52) U.S. Cl.
USPC ..... 75/252; 75/231; 419/14; 419/36

(58) Field of Classification Search ..... 75/255, 75/228–254; 419/10–22
See application file for complete search history.

(56) References Cited

U.S. PATENT DOCUMENTS

| | | | | |
|---|---|---|---|---|
| 3,410,684 | A | 11/1968 | Printz | |
| 3,442,668 | A * | 5/1969 | Fenerty et al. | 501/1 |
| 3,859,056 | A | 1/1975 | Hara et al. | |
| 4,070,184 | A | 1/1978 | Scheithauer, Jr. et al. | |
| 4,478,888 | A | 10/1984 | Benjamin et al. | |
| 4,886,638 | A | 12/1989 | Penkunas et al. | |
| 4,902,471 | A * | 2/1990 | Penkunas et al. | 419/33 |
| 6,228,139 | B1 | 5/2001 | Oskarsson | |
| 7,387,658 | B2 * | 6/2008 | Grearson et al. | 75/252 |
| 2007/0006678 | A1 | 1/2007 | Grearson et al. | |

FOREIGN PATENT DOCUMENTS

| | | |
|---|---|---|
| EP | 0 543 375 A1 | 5/1993 |
| EP | 1 043 413 | 10/2000 |
| EP | 0 963 454 B1 | 12/2002 |
| JP | 1-294807 | 11/1989 |
| JP | 7-90305 | 4/1995 |
| JP | 2000-336437 | 12/2000 |
| WO | 98/18973 | 5/1998 |
| WO | WO 9830348 A1 * | 7/1998 |

OTHER PUBLICATIONS

Notice of Reasons for Rejection, with translation, for Japanese Application 2006-206890, dated Jul. 3, 2011.

* cited by examiner

*Primary Examiner* — Roy King
*Assistant Examiner* — Christopher Kessler
(74) *Attorney, Agent, or Firm* — Morgan, Lewis & Bockius LLP

(57) ABSTRACT

There is disclosed a method of making a ready to press cemented carbide powder with low compaction pressure suitable for the production of submicron cemented carbide by means of powder metallurgical techniques milling, pressing and sintering. The method comprises using from about 1 to about 3 wt-% pressing agent with the following composition, less than about 90 wt-% PEG and from about 10 to about 75 wt-% of blends of high molecular (C12-<C20) saturated or unsaturated fatty acids, or salts thereof containing at least one element of Al, Ba, Ca, Co, Cr, Mg, N, Na, V, Zn. Preferably the grain size of the cemented carbide powder is submicron. In a preferred embodiment the method includes a dry pre-milling of the hard constituents mainly WC-powder for about 2-45 hours in ball mills with cemented carbide milling bodies or using other suitable dry milling techniques prior to a wet milling step. The invention also relates to the powder obtained by the method.

23 Claims, No Drawings

METHOD OF MAKING A SUBMICRON CEMENTED CARBIDE POWDER MIXTURE WITH LOW COMPACTING PRESSURE AND THE RESULTING POWDER

BACKGROUND OF THE INVENTION

The present invention relates to a method of making fine grained in particular submicron and nano sized cemented carbide powders with low compaction pressure and the powder obtained.

Cemented carbide is made by wet milling of powders forming hard constituents, powders forming binder phase and pressing agents generally PEG (Polyethylene glycol) to a slurry, drying the slurry generally by spray drying, tool pressing the dried powder to bodies of desired shape and finally sintering. During sintering the bodies shrink about 16-20% linearly. The shrinkage depends on pressing pressure, WC grain size, grain size distribution and Cocontent. Pressing tools are expensive to make and are therefore made for a standard linear shrinkage such as 18%. The correct shrinkage is obtained by applying a particular pressing pressure to a certain amount of powder. It is extremely important that the sintered body has a size and shape as close as possible to the desired one in order to avoid expensive post sintering operations such as grinding. However, if the grain size is fine, for example submicron or finer, a higher pressing pressure is needed to obtain a green density that gives the necessary shrinkage. A high pressing pressure is not desirable because of the risk of obtaining pressing cracks in the pressed bodies and an abnormal wear of the compacting tools and even a risk of tool failure and injuries to the operators. Moreover dimensional control of the whole sintered part is facilitated if the pressing pressure is kept within a certain interval.

A method of lowering the compacting pressure for submicron cemented carbide is disclosed in EP-A-1043413. The described method consists in premixing all components except WC for about three hours, adding the WC powder and then finally milling for about ten hours.

A common pressing agent in iron powder metallurgy is Zn-stearate.

OBJECTS AND SUMMARY OF THE INVENTION

It is an object of the present invention to provide methods of reducing the pressing pressure when making fine grained cemented carbides.

In one aspect of the invention, there is provided in a method of making a ready to press cemented carbide powder suitable for the production of submicron cemented carbide by the powder metallurgical techniques milling, pressing and sintering of powders comprising WC, binder metal and a pressing agent, the improvement comprising using from about 1 to about 3 wt-% pressing agent of the following composition, less than about 90 wt-% PEG and from about 10 to about 75 wt-% of blends of high molecular weight (C12-<C20) saturated or unsaturated fatty acids, or salts thereof containing at least one element of Al, Ba, Ca, Co, Cr, Mg, N, Na, V, or Zn.

In another aspect of the invention, there is provided ready to press powder for making cemented carbide with low compaction pressure comprising from about 1 to about 3 wt-% of a pressing agent of the following composition, less than about 90 wt-% PEG and from about 10 to about 75 wt-% of blends of high molecular weight (C12-<C20) saturated or unsaturated fatty acids, or salts thereof containing at least one element of Al, Ba, Ca, Co, Cr, Mg, N, Na, V or Zn.

DETAILED DESCRIPTION OF THE PREFERRED EMBODIMENTS

It has now surprisingly been found that a submicron cemented carbide powder with a reduced compacting pressure at a predetermined weighing in for 18% linear shrinkage can be obtained if a mixture of PEG and a fatty acid compound consisting of a blend of salts of higher molecular weight, mostly unsaturated, C12-<C20 fatty acids is used as pressing agent in combination with pre-milling of the hard constituents, preferably in the dry state.

The method of the present invention can be applied to all kinds of cemented carbides comprising WC and/or other carbides and from about 2 to about 20 wt-% Co, preferably from about 5 to about 15 wt-% Co. It is particularly useful for submicron cemented carbide with an average grain size in the range from about 0.2 to about 1.2 μm, preferably from about 0.3 to about 1.0 μm, with essentially no WC grains greater than about 1.5 μm and containing grain growth inhibitors in particular less than about 1 wt-% Cr and/or less than about 1 wt-% V.

The present invention thus relates to a method of making a ready to press cemented carbide powder suitable for the production of submicron cemented carbide by means of powder metallurgical techniques wet milling, pressing and sintering. The wet milling is performed, e.g., in ethanol of powders of WC, possibly also other hard constituents, and binder metal, possibly carbon black or tungsten powder, and a pressing agent, respectively. The carbon black or tungsten powder may be added to adjust the carbon balance as desired and as understood by the skilled artisan. The method comprises using from about 1 to about 3 wt-% pressing agent comprising less than about 90 wt-% PEG and from about 10 to about 75 wt-%, preferably from about 25 to about 50 wt-%, of blends of high molecular weight (C12-<C20) saturated or unsaturated fatty acids, or salts thereof containing at least one element of Al, Ba, Ca, Co, Cr, Mg, N, Na, V or Zn, preferably Co, Cr, N, V or Zn, dried, preferably by spray drying, compacted to bodies of desired shape and sintered to form dense, homogenous, high performance cemented carbide inserts.

In a preferred embodiment of the present invention, the milling procedure is started with a pre-milling step in which the powders forming the hard constituents are dry milled between from about 2 and to about 45 hours using ball mills with cemented carbide milling bodies or other suitable dry milling techniques. The required dry milling time depends on the size of the mill, the powder grain size, and the desired final pressing pressure or shrinkage and can be readily determined by the skilled artisan. The pre-milling step is followed by the final wet milling step described above.

The present invention also relates to a ready to press powder for making cemented carbide with low compaction pressure. The powder contains from about 1 to about 3 wt-% of a pressing agent with the following composition, less than about 90 wt-% PEG and from about 10 to about 75 wt-%, preferably from about 25 to about 50 wt-%, of blends of high molecular weight (C12-<C20) saturated or unsaturated fatty acids, or salts thereof containing at least one element of Al, Ba, Ca, Co, Cr, Mg, N, Na, V or Zn, preferably Co, Cr, N, V or Zn. In a preferred embodiment, the grain size of the powder is submicron.

The invention is additionally illustrated in connection with the following examples, which are to be considered as illustrative of the present invention. It should be understood, however, that the invention is not limited to the specific details of the examples.

EXAMPLE 1

A submicron cemented carbide powder mixture with the composition WC with an average grain size of 0.8 μm-0.3 wt-% Cr-6 wt-% Co was produced according to the invention. The milling was carried out in ethanol (0.3 l fluid per kg cemented carbide powder) in a 2.5 l laboratory mill with 8 kg milling bodies and the batch size was 2 kg. The following pressing agents were used:

1A—PEG40 g (prior art)

1B—PEG 28 g+12 g of a blend of zinc salts of higher molecular, mostly unsaturated fatty acids.

After spray drying, inserts of SNUN120408 were compacted and sintered according to standard practice. During the pressing operation, the compaction pressure was recorded with the following results, average of six inserts:

| Sample | Compaction pressure, Mpa |
|---|---|
| 1A | 155 |
| 1B | 77 |

EXAMPLE 2

Example 1 was repeated using a WC-powder that had been dry pre-milled in a small 2.5 l laboratory ball mill with 8 kg milling bodies and 2.0 kg WC powder for 12 h. The following pressing pressures were obtained:

| Sample | Compaction pressure, Mpa |
|---|---|
| 2A | 130 |
| 2B | 47 |

The sintered inserts of these two examples were subjected to routine metallurgical inspection. Dense sintered structures were obtained and no signs of porosity or pressing cracks were found. The recorded pressing pressure was, however, much lower for the samples in Example 2 than for those in Example 1. Furthermore, it was found that the pressing pressures for samples 1 B and 2B were a great deal lower than for the corresponding samples, 1A and 2A containing only PEG as pressing agent. These findings are definitely advantageous to pressing tool life.

EXAMPLE 3

A submicron cemented carbide powder mixture with the composition WC with an average grain size of 0.3 μm-0.5 wt-% Cr-10 wt-% Co was produced according to the invention. The milling was carried out in ethanol (0.3 l fluid per kg cemented carbide powder) in a 2.5 l laboratory mill with 8 kg milling bodies and the batch size was 2 kg. The following pressing agents were used:

3A—PEG 40 g (prior art)

3B—PEG 25 g+15 g of a blend of zinc salts of higher molecular, mostly unsaturated fatty acids 3C—PEG 25 g+15 g Co-stearate 3D—PEG 28 g+12 g oleic acid.

After spray drying, inserts of SNUN120408 were compacted and sintered according to standard practice. During the pressing operation the compaction pressure was recorded with the following results at a relative green density of 0.55, average of six inserts: SampleCompaction pressure, MPa

| Sample | Compaction pressure, Mpa |
|---|---|
| 3A | 550 |
| 3B | 450 |
| 3C | 490 |
| 3D | 460 |

The sintered inserts were subjected to routine metallurgical inspection. Dense sintered structures were obtained with no signs of pressing cracks or larger pores were found except for sample 3A.

EXAMPLE 4

Example 3 was repeated using a WC-powder that had been dry pre-milled in a small 2.5 l laboratory ball mill with 8 kg milling bodies and 2.0 kg WC powder for 35 h. The following pressing pressures were obtained when compacted to a relative green density of 0.55: SampleCompaction pressure, MPa

| Sample | Compaction pressure, Mpa |
|---|---|
| 4A | 195 |
| 4B | 120 |
| 4C | 140 |
| 4D | 130 |

The sintered inserts were subjected to routine metallurgical inspection. Dense sintered structures were obtained and no signs of larger pores or pressing cracks were found in 4A-4D. The recorded pressing pressures were, however, much less for the samples in Example 4 than those in Example 3. We also found that the pressing pressures for samples 4B-4D were significantly lower than the pressure obtained for sample 4A, which contains only PEG as pressing agent. These findings are of course important in minimizing the wear of the pressing tools and the risk of tool failure.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A method of making a ready to press cemented carbide powder suitable for the production of submicron cemented carbide comprising the steps of wet milling, pressing and sintering powders comprising WC, binder metal and a pressing agent, wherein the pressing agent comprises from about 1 to about 3 wt-% of total weight of the powder, and wherein the pressing agent comprises less than about 90 wt-% PEG and from about 10 to about 75 wt-% of at least one compound selected from the group consisting of high molecular weight (C12-<C20) saturated fatty acids, high molecular weight (C12-<C20) unsaturated fatty acids, and salts thereof containing at least one element of Al, Ba, Ca, Co, Cr, Mg, N, Na, V, or Zn.

2. In the method of claim 1, wherein a grain size of the cemented carbide powder is submicron.

3. In the method of claim 1, wherein the WC and any other hard constituents are dry pre-milled from about 2 to about 45 hours in ball mills with cemented carbide milling bodies.

4. In the method of claim 1, wherein the powders also comprise other hard constituents.

5. In the method of claim 1, wherein the powders also comprise carbon black or tungsten powder.

6. In the method of claim 1, wherein the elements are Co, Cr, N, V or Zn.

7. In the method of claim 1, wherein the pressing agent includes from about 25 to about 50 wt-% of the at least one compound.

8. In the method of claim 1, wherein the cemented carbide comprises from about 2 to about 20 wt-% Co based on total weight of the cemented carbide.

9. In the method of claim 1, wherein the cemented carbide comprises grain growth inhibitors.

10. In the method of claim 9, wherein the grain growth inhibitors include less than about 1 wt-% Cr and/or less than about 1 wt-% V.

11. In the method of claim 1, wherein the elements are Al, Ba, Ca, Mg, or Na.

12. In the method of claim 1, wherein the elements are Al, Ba, Ca, Co, Cr, Mg, N, Na, or V.

13. In the method of claim 1 , wherein a grain size of the cemented carbide powder is from about 0.3 to about 1.0 gm.

14. In the method of claim 1, wherein the at least one compound includes a salt containing:

at least one element of Al, Ba, Ca, Co, Cr, Mg, N, Na, V, or Zn; and either high molecular weight (C12-<C20) saturated fatty acid or high molecular weight (C12-<C20) unsaturated fatty acid.

15. In the method of claim 1, wherein the pressing agent includes less than about 90 wt-% PEG and from about 10 to about 75 wt-% of a blend of at least two compounds selected from the group consisting of high molecular weight (C12-<C20) unsaturated fatty acids, high molecular weight (C12-<C20) saturated fatty acids, and salts thereof containing at least one element of Al, Ba, Ca, Co, Cr, Mg, N, Na, V, or Zn.

16. Ready to press powder for making cemented carbide with low compaction pressure comprising from about 1 to about 3 wt-% of a pressing agent, which comprises less than about 90 wt-% PEG and from about 10 to about 75 wt-% of at least one compound selected from the group consisting of high molecular weight (C12-<C20) saturated fatty acids, high molecular weight (C12-<C20) unsaturated fatty acids, and salts thereof containing at least one element of Al, Ba, Ca, Co, Cr, Mg, N, Na, V or Zn.

17. A powder according to claim 16, wherein a grain size of the cemented carbide powder is submicron.

18. A ready to press powder of claim 16 wherein the powders also comprise other hard constituents.

19. A ready to press powder of claim 16 wherein the powders comprise carbon black and tungsten powder.

20. A ready to press powder of claim 16 wherein the elements are Co, Cr, N, V or Zn.

21. A ready to press powder of claim 16 wherein the pressing agent includes from about 25 to about 50 wt-% of the at least one.

22. A ready to press powder of claim 16, wherein the at least one compound includes a salt containing:

at least one element of Al, Ba, Ca, Co, Cr, Mg, N, Na, V, or Zn; and either high molecular weight (C12-<C20) saturated fatty acid or high molecular weight (C12-<C20) unsaturated fatty acid.

23. A ready to press powder of claim 16, wherein the pressing agent includes less than about 90 wt-% PEG and from about 10 to about 75 wt-% of a blend of at least two compounds selected from the group consisting of high molecular weight (C12-<C20) unsaturated fatty acids, high molecular weight (C12-<C20) saturated fatty acids, and salts thereof containing at least one element of Al, Ba, Ca, Co, Cr, Mg, N, Na, V, or Zn.

* * * * *